US009955839B2

(12) United States Patent
Maoro et al.

(10) Patent No.: US 9,955,839 B2
(45) Date of Patent: May 1, 2018

(54) SIDE BRUSH FOR A ROBOTIC VACUUM CLEANER AND ROBOTIC VACUUM CLEANER COMPRISING A SIDE BRUSH

(71) Applicant: Miele & Cie. KG, Guetersloh (DE)

(72) Inventors: Carina Maoro, Bielefeld (DE); Markus Thamm, Leopoldshoehe (DE); Thomas Pott, Bielefeld (DE); Mark Hanschur-Steiner, Bielefeld (DE); Sebastian Doering, Bielefeld (DE); Thomas Buchholz, Rheda-Wiedenbrueck (DE); David Buhl, Bielefeld (DE); Martin Roth, Bielefeld (DE)

(73) Assignee: MIELE & CIE. KG, Guetersloh (DE)

( * ) Notice: Subject to any disclaimer, the term of this patent is extended or adjusted under 35 U.S.C. 154(b) by 51 days.

(21) Appl. No.: 14/949,899

(22) Filed: Nov. 24, 2015

(65) Prior Publication Data

US 2016/0157692 A1 Jun. 9, 2016

(30) Foreign Application Priority Data

Dec. 8, 2014 (DE) ..... 10 2014 118 136

(51) Int. Cl.

| | |
|---|---|
| ***A46B 7/08*** | (2006.01) |
| ***A47L 11/40*** | (2006.01) |
| ***A46B 9/02*** | (2006.01) |
| ***A47L 9/28*** | (2006.01) |
| ***A46B 13/00*** | (2006.01) |
| ***A47L 9/04*** | (2006.01) |

(52) U.S. Cl.

CPC ..... *A47L 11/4038* (2013.01); *A46B 7/08* (2013.01); *A46B 9/02* (2013.01); *A46B 9/028* (2013.01); *A46B 13/008* (2013.01); *A47L 9/0472* (2013.01); *A47L 9/2852* (2013.01); *A46B 2200/3033* (2013.01); *A47L 2201/00* (2013.01); *A47L 2201/04* (2013.01)

(58) Field of Classification Search

CPC .... A46B 7/06; A46B 7/08; A46B 9/02; A46B 9/028; A46B 13/008; A46B 2200/3033; A47L 9/0472; A47L 9/2852; A47L 9/0488; A47L 2201/00; A47L 2201/04; A47L 11/4038

USPC ..... 15/207.2, 28, 87, 180, 179, 42

See application file for complete search history.

(56) References Cited

U.S. PATENT DOCUMENTS

| | | | | |
|---|---|---|---|---|
| 1,565,261 | A * | 12/1925 | Cutler | A47L 23/02 15/179 |
| 1,942,204 | A * | 1/1934 | Courchene | A47L 11/33 15/118 |
| 4,691,403 | A | 9/1987 | Scharf | |

FOREIGN PATENT DOCUMENTS

| | | |
|---|---|---|
| DE | 9305659 U1 | 6/1993 |
| EP | 2606798 A2 | 6/2013 |
| EP | 2891444 A1 | 7/2015 |

(Continued)

*Primary Examiner* — David Redding

(74) *Attorney, Agent, or Firm* — Leydig, Voit & Mayer, Ltd.

(57) ABSTRACT

A side brush for a robotic vacuum cleaner includes a brush core, a plurality of bristle clusters having a first length, and a plurality of further bristle clusters having a shorter length than the first length. The plurality of bristle clusters and the plurality of further bristle clusters are regularly distributed over a circumferential surface of the brush core.

11 Claims, 4 Drawing Sheets

(56) References Cited

FOREIGN PATENT DOCUMENTS

| | | | |
|---|---|---|---|
| GB | 1409561 | A | 10/1975 |
| NL | 7213505 | A | 4/1973 |

* cited by examiner

SIDE BRUSH FOR A ROBOTIC VACUUM CLEANER AND ROBOTIC VACUUM CLEANER COMPRISING A SIDE BRUSH

CROSS-REFERENCE TO PRIOR APPLICATION

Priority is claimed to German Patent Application No. DE 10 2014 118 136.0, filed on Dec. 8, 2014, the entire disclosure of which is hereby incorporated by reference herein.

FIELD

The invention relates to a side brush for a vacuum cleaner (robotic vacuum cleaner side brush), in particular a side brush for an autonomous, self-propelled vacuum cleaner system (robotic vacuum cleaner), and a vacuum cleaner, in particular a vacuum cleaner which is designed as a robotic vacuum cleaner comprising at least one such side brush.

BACKGROUND

Vacuum cleaners or robotic vacuum cleaners have certain shapes in a region in contact with the surface to be cleaned in order to gather and transport the usually solid dust and dirt particles using certain physical principles. An important principle is the pulsed solid contact between the brush filaments and the floor being worked on in each case, as well as the dirt particles found thereon. In this way, said dirt particles are mobilised and transported.

The frequently round or substantially round basic shape of robotic vacuum cleaners makes it difficult to reach dirt particles in corners. In order to increase the surface-cleaning capacity, it is therefore of particular importance, especially in robotic vacuum cleaners, for the regions to the right and left of the suction mouth itself to be worked on by assistive side brushes which protrude beyond the diameter of the housing. An essential aim of such side brushes and the bristle clusters thereof is to solely mechanically move dirt particles found on the floor using the brush filaments of the bristle clusters and to deliver them to the suction mouth.

Such side brushes are known, for example from EP 2 606 798 A2. Known side brushes comprise just a few regularly spaced brush arms in the form of paintbrush-like brushes, that is to say bristle clusters or sleeves having bristle clusters fastened therein. The known side brushes comprise two, three, four or five brush arms of this type, and in any case comprise few brush arms.

The drawback of such side brushes is primarily the unsatisfactory surface coverage. This results firstly from the fact that a side brush comprises just a few bristle clusters, so that a drop sensor positioned in the movement region of the bristle clusters is not, or at least not unnecessarily, disrupted. A drop sensor of this type is provided, in a known manner, for detecting steps or other drops in the surface, and said drop sensor operates on the basis of a reflection of light signals emitted towards the floor which is detected by means of a sensor system in each case. In a drop sensor positioned in the movement region of the bristle clusters of a side brush, the bristle clusters of a rotating side brush either interrupt the beam path from the light source or the beam path to the sensor system. Such an interruption to the beam path results in a reduction in the quantity of light arriving at the sensor system, and therefore a differentiation cannot readily be made between such an interruption and a reflection of light which does not occur owing to a step or the like being located in front of the robotic vacuum cleaner. Such a differentiation can only be made for a few bristle clusters by taking into account the time profile of a signal received by the sensor system and by a conclusion being drawn on a situation in which a fall is likely if, for example, an amount of light arriving at the sensor system over a relatively long time period is below a threshold value. However, the unsatisfactory surface coverage also results from the fact that, for example in a robotic vacuum cleaner, the speed when moving over a portion of floor to be worked on in each case is so high relative to the rotational speed of the side brushes that the areas covered by the individual bristle clusters are several millimeters to several centimeters apart. This leads to dirt, such as individual crumbs or the like, not being gathered by the side brushes and remaining on the surface to be cleaned.

In general, the driving speed of the robotic vacuum cleaner should not be reduced because otherwise the surface area performance of the robotic vacuum cleaner decreases. Likewise, the quantity of bristle clusters of a side brush cannot readily be increased owing to the requirement for detecting falls. Similarly, the position of the drop sensor cannot readily be modified because it is necessary for the drop sensor to always be located at a certain distance in front of and laterally next to a driven or non-driven wheel of the robotic vacuum cleaner. The required position of the drop sensor in this respect results in the drop sensor being positioned in the movement region of the bristle clusters.

SUMMARY

In an embodiment, the present invention provides a side brush for a robotic vacuum cleaner including a brush core, a plurality of bristle clusters having a first length, and a plurality of further bristle clusters having a shorter length than the first length. The plurality of bristle clusters and the plurality of further bristle clusters are regularly distributed over a circumferential surface of the brush core.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
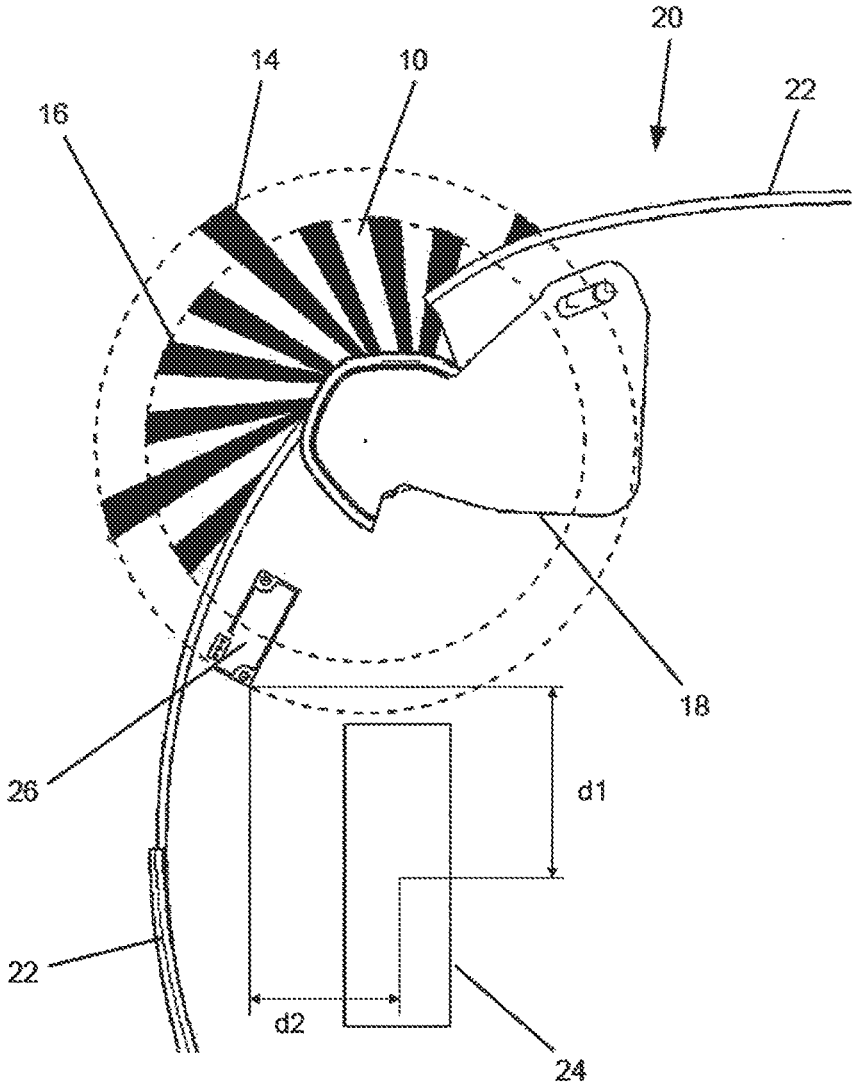
FIG. 1 is a sectional view of a portion of a robotic vacuum cleaner comprising a side brush that is attached to a movable side arm.

In an embodiment, the present invention provides a side brush having improved surface coverage, and a robotic vacuum cleaner comprising at least one such side brush.

In an embodiment the present invention provides a side brush for a robotic vacuum cleaner, referred to in the following as a robotic vacuum cleaner side brush, or simply side brush for short. The robotic vacuum cleaner side brush proposed here, comprising a brush core and bristle clusters that are regularly distributed over a circumferential surface of the brush core is distinguished by a plurality of bristle clusters having a first length and a plurality of further bristle clusters having a shorter length than said first length, and thus by a greater total number of bristle clusters than in previous side brushes. The invention also relates to a robotic vacuum cleaner comprising at least one such side brush. Such a robotic vacuum cleaner is distinguished in that it comprises at least one such side brush at a standard position for a side brush, or one such side brush at each of the standard positions for a side brush, that is to say at least two side brushes.

The robotic vacuum cleaner side brush proposed here comprises, in brief, long bristle clusters, namely the bristle clusters having the first length, and short, or shorter, bristle clusters, namely the further bristle clusters. The long bristle clusters work in the same manner as previous bristle clusters of a robotic vacuum cleaner side brush, and the length (first length) of these bristle clusters defines the maximum working range of the robotic vacuum cleaner side brush and of the brush filaments comprised thereby. The short, or shorter, bristle clusters have a length which is such that the brush filaments thereof do not interrupt the beam path from and/or to the drop sensor. The function of the drop sensor is not impaired by the robotic vacuum cleaner side brush proposed here. At the same time, however, the surface coverage of the robotic vacuum cleaner side brush is improved owing to the relatively high total number of bristle clusters, namely the number of the further short, or shorter, bristle clusters. As a result, the quality of the cleaning result increases without reducing the driving speed of the robotic vacuum cleaner, without having to accept an impaired detection of steps and the like, or without having to tolerate an inconvenient positioning of the drop sensor.

In one embodiment of the robotic vacuum cleaner side brush, a group of further bristle clusters is attached in each case to the brush core between two bristle clusters having the first length. As a result, a regularly alternating sequence of long and short, or shorter, bristle clusters in the circumferential direction is produced. The regular sequence of the bristle clusters ensures good surface coverage of the robotic vacuum cleaner side brush.

In a specific embodiment of the robotic vacuum cleaner side brush, all of the further bristle clusters are of the same length or at least substantially of the same length. In order to improve readability, the following description will in many cases only use the wording "of the same length". This should however always be read as "of the same length or at least substantially of the same length".

In a variant of this specific embodiment of the robotic vacuum cleaner side brush, in each group of further bristle clusters, the length of one further bristle cluster increases or decreases in relation to the length of the closest further bristle cluster. In this manner, the side brush comprises further bristle clusters of different lengths next to the long bristle clusters. As a result, even when a robotic vacuum cleaner is stationary or only moving slowly, the surface coverage is improved because the long bristle clusters brush the coverage region of the side brush along an outer circumferential line, and the shorter further bristle clusters brush the inside of the coverage region along concentric inner circumferential lines.

In an alternative variant of the robotic vacuum cleaner side brush comprising further bristle clusters of different lengths, in each group of further bristle clusters, the length of one further bristle cluster increases and decreases in an alternating manner in relation to the length of the closest further bristle cluster. This also results in a plurality of inner circumferential lines which are covered by the respective further bristle clusters, and the robotic vacuum cleaner side brush has good surface coverage accordingly.

In one embodiment of the robotic vacuum cleaner side brush, the bristle clusters and the further bristle clusters are each fastened to the brush core in an orientation that is tangential to the circumferential surface of the brush core and counter to the rotational direction of the robotic vacuum cleaner side brush, for example in tangentially oriented sleeves on the brush core and/or in tangentially oriented holes in the brush core. This tangential orientation results in each bristle cluster and each further bristle cluster likewise being oriented tangentially or at least substantially tangentially to the circumferential surface of the brush core. A bristle cluster which runs perpendicularly into an obstacle may disadvantageously influence the manoeuvrability of a robotic vacuum cleaner. For bristle clusters oriented tangentially to the circumferential surface of the brush core, the foremost end of a bristle cluster of the side brush in the direction of travel never runs perpendicularly into a potential obstacle, and therefore the disadvantageous effect on manoeuvrability that is otherwise possible does not occur. When the bristle cluster having the foremost end comes into contact with an obstacle, it is deflected to a greater extent towards the tangential orientation that is already present, and this presents at most a negligibly small amount of resistance for the forward movement of the robotic vacuum cleaner. Another advantage of the tangential orientation, for example tangentially oriented sleeves or holes, by comparison with for example radially oriented sleeves or holes, is the low proportion of the insertion depth of the individual bristle clusters inside each sleeve or hole when measured in the radial direction. In tangentially oriented sleeves or holes, each portion of a bristle cluster that is fastened therein may be positioned at an insertion depth in the sleeve or hole that goes beyond the radius of the brush core. Comparably secure fastening of the bristle cluster in a radially oriented sleeve or hole can only be achieved by a significantly larger brush core, namely a brush core having a greater diameter. The tangential orientation thus prevents the brush core from having to be designed to be unnecessarily large.

In another additional embodiment of the robotic vacuum cleaner side brush, the bristle clusters and the further bristle clusters are arranged in at least two parallel planes on the brush core, a plurality of bristle clusters and/or further bristle clusters being positioned in each plane, in particular such that the same number of bristle clusters or at least substantially the same number of bristle clusters are positioned in each insertion plane. The use of a plurality of parallel insertion planes, that is to say at least two parallel insertion planes, makes it possible, in a particularly advantageous manner, to increase the number of bristle clusters, as sought in order to improve the surface coverage, without this affecting the stability of the brush core or making it necessary to design said core to be disadvantageously large in order to improve the stability.

An embodiment of the invention is shown in a purely schematic manner in the drawings and will be described in greater detail below. Corresponding objects or elements are provided with the same reference numerals in all the figures. The embodiment should not be understood as a restriction of the invention. Instead, modifications are also possible within the scope of the present disclosure, in particular those which can be inferred by a person skilled in the art with a view to solving the problem by, for example, combining or amending individual features and elements or method steps that are described in connection with the general or specific part of the description and contained in the claims and/or the drawings, and which lead to new subject matter or new method steps by way of combinable features.

Figure 2:
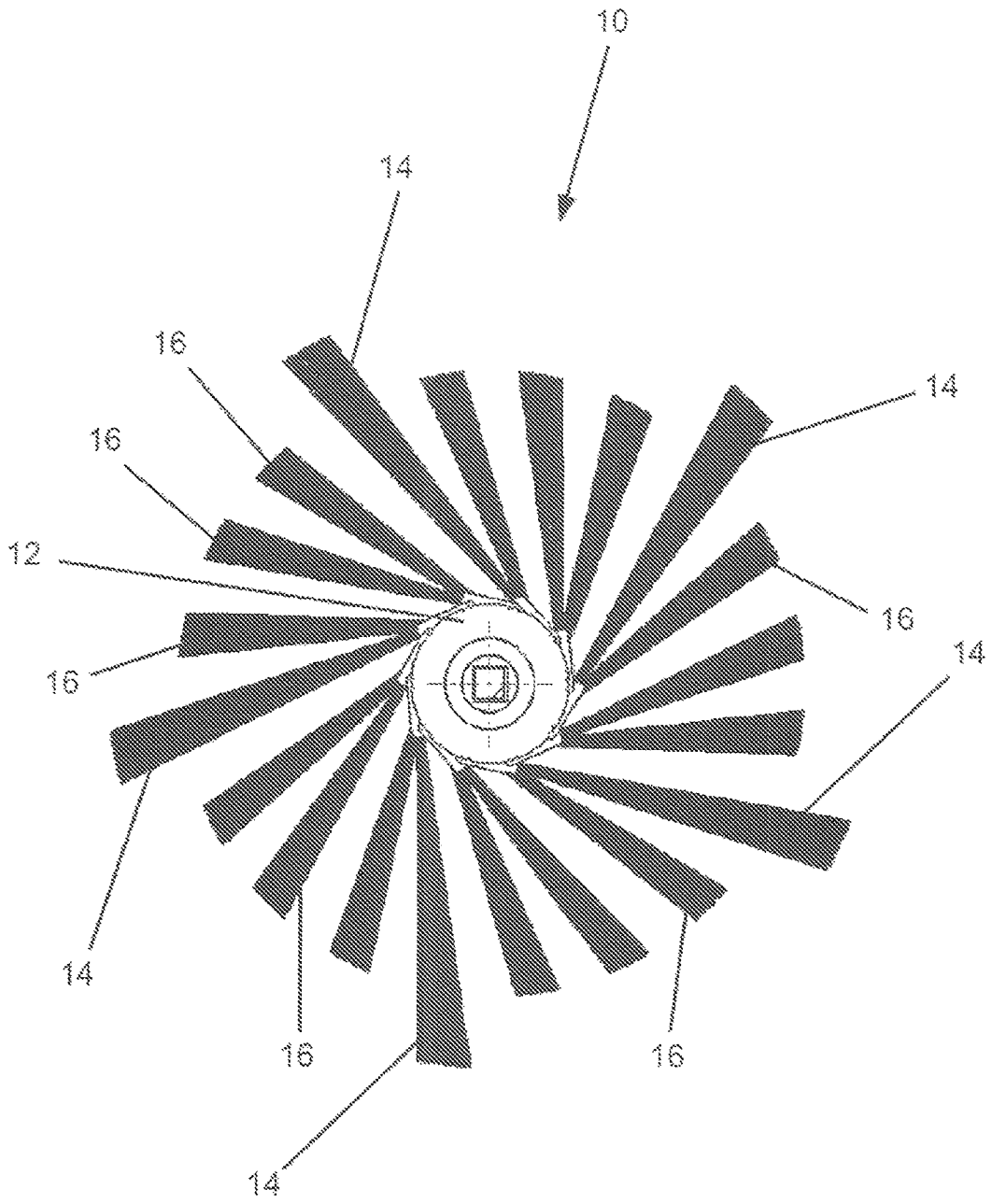
FIG. 2 is an enlarged view of the side brush from FIG. 1.
Figure 3:
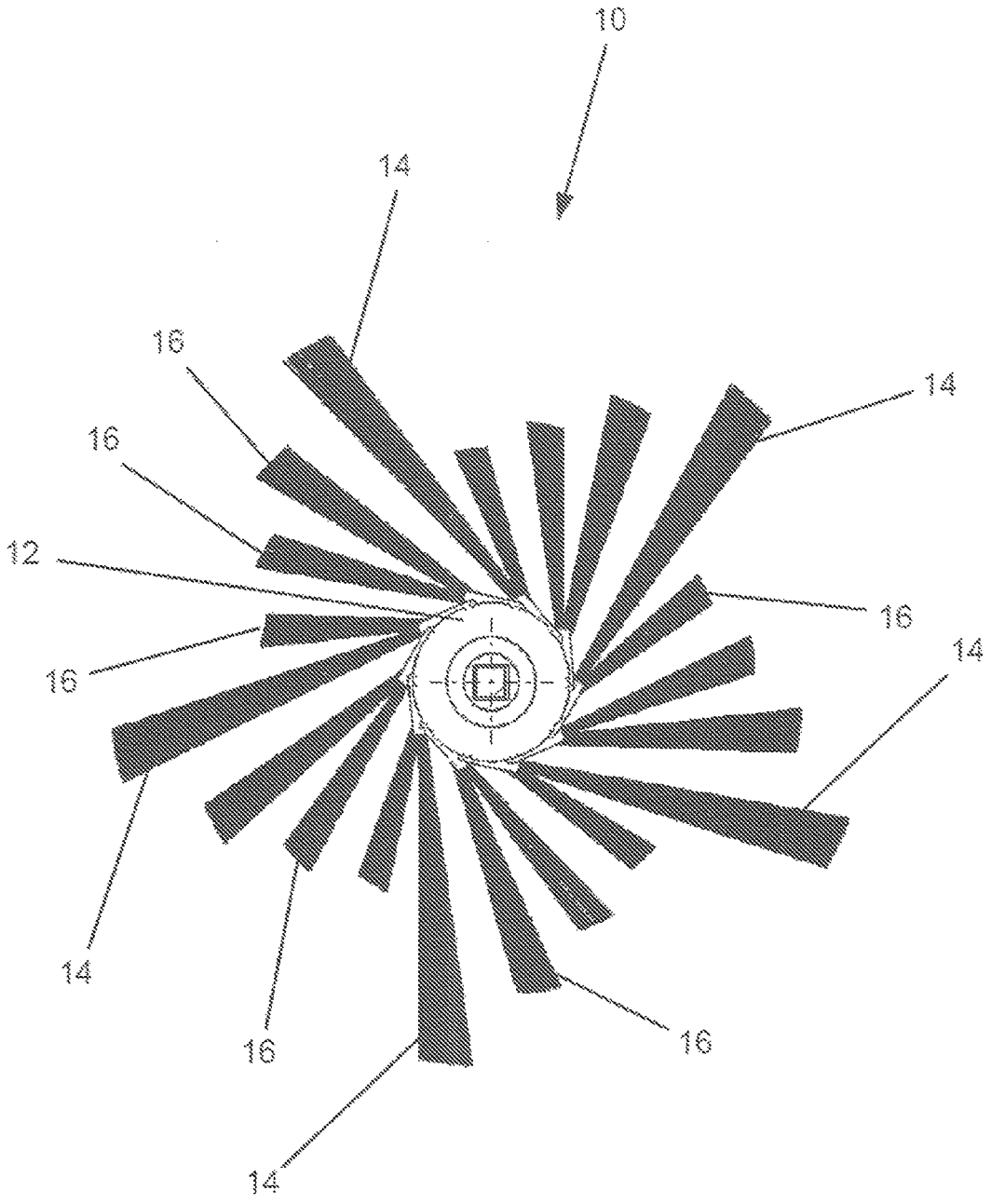
FIG. 3 and FIG. 4 show further embodiments of a side brush for a robotic vacuum cleaner.
Figure 4:
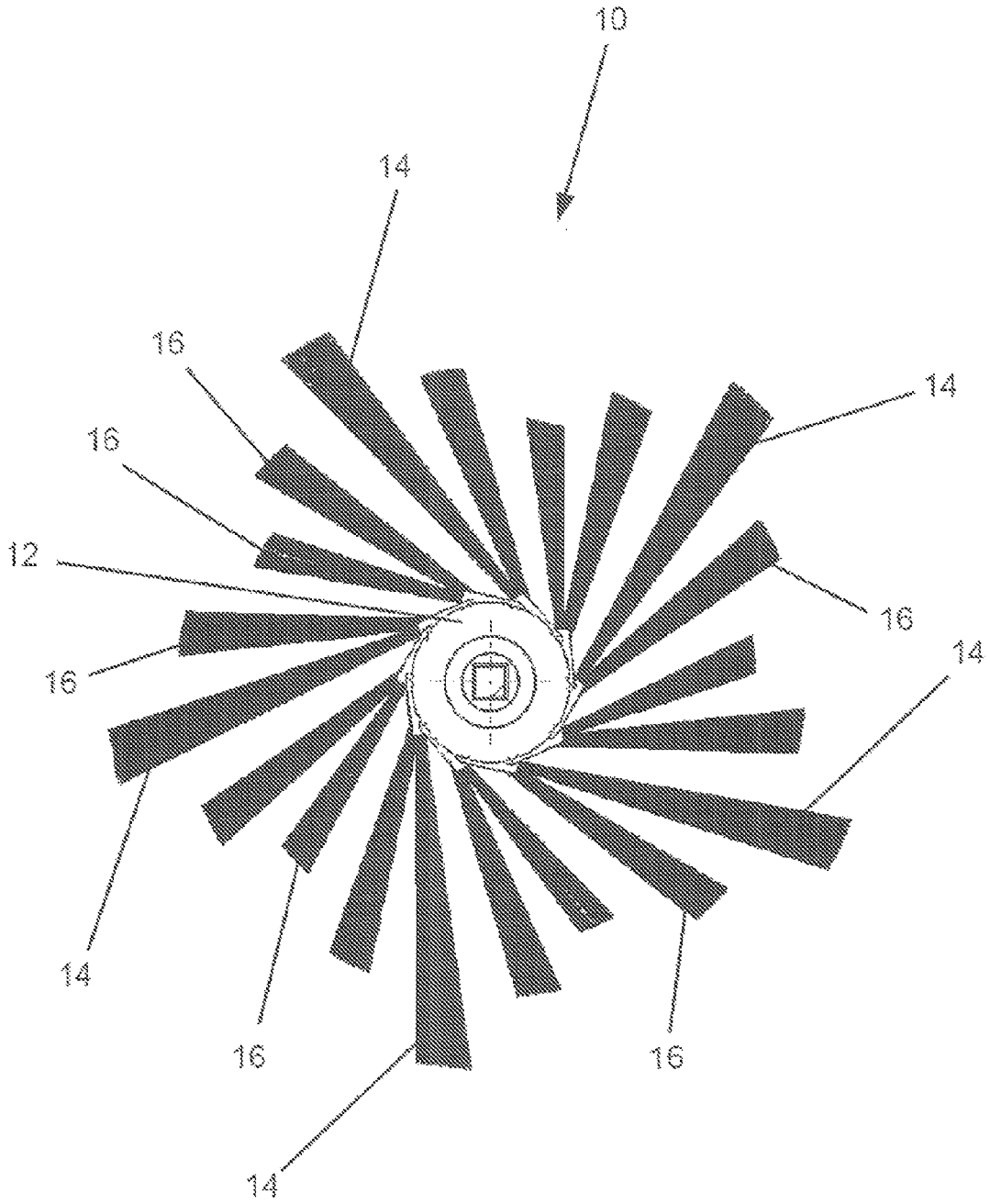

FIG. 1 shows a robotic vacuum cleaner side brush 10, also referred to in the following as side brush 10 for short. The side brush 10 comprises a plurality of bristle clusters 14, 16 fastened to a brush core 12 (FIGS. 2, 3 and 4). The side brush 10 is rotatably attached by the brush core thereof to a side arm 18 of a robotic vacuum cleaner 20, of which a portion of a housing 22, a wheel 24 acting as an impeller of driving wheel and a drop sensor 26 is shown in FIG. 1. FIG. 1 is a sectional view, in a sectional plane parallel to the floor to be worked on, of a portion of the robotic vacuum cleaner 20, namely a portion comprising a left side arm 18 in the direction of travel and a left side brush 10 accordingly. A corresponding right side brush which is attached to a side arm in an identical manner is not shown. The following embodiments apply equally to the left side brush 10 and to the right side brush.

In the shown embodiment of the robotic vacuum cleaner 20, the side arm 18 is designed to be at least pivotally movable. Owing to this mobility or a similar mobility, the side arm 18 together with the side brush 10 can be retracted into the inside of the housing 22 of the robotic vacuum cleaner 20 in the event of contact with an obstacle.

During operation of the robotic vacuum cleaner 20, the side brush 10 rotates on the free end of the side arm 18. The two dashed circles shown in FIG. 1 show the coverage region of the side brush 10 and the bristle clusters 14, 16 thereof. The drop sensor 26 is located within this coverage region and the drop sensor 26 is positioned on the basis of a required distance from the adjacent wheel 24. In order for the robotic vacuum cleaner 20 to be stopped in due time on the basis of a signal generated by the drop sensor 26, said signal being generated by the drop sensor 26 if, for example, a step is detected in front of the robotic vacuum cleaner 20, the drop sensor 26 must be located at a certain distance (d1) in front of the wheel 24. Furthermore, if the robotic vacuum cleaner 20 moves in parallel with a step edge or the like, or travels on such an edge at an angle, it is necessary for the drop sensor 26 to also be located at a certain distance (d2) next to the wheel 24. The position of the drop sensor 26 in the housing 22 of the robotic vacuum cleaner 20 is therefore substantially predetermined, and owing to the position of the side brush 10 which is likewise predetermined, the drop sensor 26 must be attached in the coverage region of the side brush 10.

As mentioned at the outset, the bristle clusters 14, 16 of a rotating side brush 10 interrupt the beam path from and to the drop sensor 26. This has previously limited the number of bristle clusters 14, 16 of a side brush 10, because, in each case, only a few bristle clusters 14, 16 (usually two, three, four, or, in exceptional cases, five bristle clusters 14, 16) interrupt the beam path for only a short time, and so a potential risk of falling can still be detected on the basis of a signal condition which exists for longer than such interruption periods.

However, few bristle clusters 14, 16, that is to say two, three, four or five bristle clusters 14, 16, result in unfavourable surface coverage of the side brush 10. To improve the surface coverage, a possibility is thus proposed here of a side brush 10 being provided with a greater number of bristle clusters 14, 16 than in previous embodiments. Twenty bristle clusters 14, 16 can for example be provided, without this affecting the reliability of an automatic detection of a possible risk of falling by means of the drop sensor 26.

The side brush 10 for a robotic vacuum cleaner 20 proposed here comprises a brush core 12 and bristle clusters 14, 16 that are regularly distributed over a circumferential surface of the brush core 12, namely a plurality of bristle clusters 14 having a first length (long bristle clusters 14), and a plurality of further bristle clusters 16 having a shorter length than the first length (short, or shorter, bristle clusters 16).

Only the long bristle clusters 14 may interrupt the beam path from and to the drop sensor 26, i.e. for example when the side arm 18 is pivoted. The number of the long bristle clusters 14 corresponds to a total number of bristle clusters 14, 16 which was previously the standard. The short, or shorter, bristle clusters 16 do not interrupt the beam path from and to the drop sensor 26. As a result, the short, or shorter, bristle clusters 16 improve the surface coverage of the side brush 10, without this affecting the reliability of the automatic detection of a potential risk of falling by means of the drop sensor 26.

In the shown embodiment, the side brush 10 comprises five long bristle clusters 14 and fifteen short, or shorter, bristle clusters 16. The bristle clusters 14, 16 are fastened to the brush core 12 in such an orientation that the tips of all the bristle clusters 14, 16 are positioned in a common plane or at least substantially in a common plane, and therefore reach as far as to the floor being worked on in each case, so that dirt particles found thereon are mobilised as intended.

FIG. 2 is an enlarged view of the side brush 10 from FIG. 1. FIG. 3 and FIG. 4 show alternative embodiments of a side brush 10 comprising long bristle clusters 14 and short, or shorter, bristle clusters 16. In the shown embodiments of the side brush 10 (FIGS. 2, 3 and 4), the bristle clusters 14, 16 are each fastened to the brush core 12 in an orientation that is tangential to the circumferential surface of the brush and in at least two parallel planes. Furthermore the short, or shorter, bristle clusters 16 are each attached in groups (groups of three in this case) between two long bristle clusters 14 adjacent thereto on either side.

In the embodiment of the side brush 10 in FIG. 2, the other short, or shorter, bristle clusters 16, which are otherwise also referred to as further bristle clusters 16, are all of the same length. Correspondingly, the two circumferential lines shown in FIG. 1 are produced for the regions covered by the ends of the bristle clusters 14, 16 when a robotic vacuum cleaner is stationary, namely a first, outer circumferential line created by the long bristle clusters 14 and a second, inner circumferential line created by the short bristle clusters 16. This improves the surface coverage of the side brush 10 even when a robotic vacuum cleaner 20 is stationary. The surface coverage is obviously also improved when a robotic vacuum cleaner 20 is moving.

In the embodiment of the side brush 10 shown in FIG. 3, in each group of further bristle clusters 16, the length of one further bristle cluster 16 increases and decreases in relation to the closest further bristle cluster 16. In the embodiment shown, the length of the further bristle clusters 16 within a group always decreases in the rotational direction (clockwise). A side brush 10 in which the length of the further bristle clusters 16 within a group increases in the rotational direction is also conceivable.

In the embodiment of the side brush 10 shown in FIG. 4, the length of one further bristle cluster 16 increases and decreases in an alternating manner in relation to the closest further bristle cluster 16. In the embodiment shown, each group of further bristle clusters 16 starts in the rotational direction (clockwise) with a further bristle cluster 16 having a medium length. The subsequent further bristle cluster 16 in the rotational direction is shorter by comparison. The further bristle cluster 16 following this second bristle cluster in the rotational direction is even longer, and so the alternating sequence of the further bristle clusters 16 of different lengths is produced. In the embodiments shown in FIG. 3 and FIG. 4, the further bristle clusters 16 of each group are of different lengths so that different inner circumferential lines are respectively produced, and an accordingly even larger surface coverage is achieved even when a robotic vacuum cleaner 20 is stationary.

The description presented here can thus be briefly summarised as follows: A side brush 10 for a robotic vacuum cleaner 20 is provided, comprising a brush core 12 and bristle clusters 14, 16 that are regularly distributed over a circumferential surface of the brush core 12, wherein the number of bristle clusters 14, 16 is greater than in previous side brushes 10 and the side brush 10 comprises a plurality of bristle clusters 14 having a first length and a plurality of further bristle clusters 16 having a shorter length than the first length. A robotic vacuum cleaner 20 comprising at least one such side brush 10, in particular a robotic vacuum cleaner 20 comprising exactly two such side brushes 10, is likewise provided.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

10 Side brush
12 Brush core
14 (Long) bristle clusters
16 (Short) further bristle clusters
18 Side arm
20 Robotic vacuum cleaner
22 Housing
24 Wheel
26 Drop sensor

What is claimed is:

1. A side brush for a robotic vacuum cleaner, the side brush comprising:
- a brush core;
- a plurality of bristle clusters having a first length; and
- a plurality of further bristle clusters having a shorter length than the first length,
- wherein the plurality of bristle clusters and the plurality of further bristle clusters are regularly distributed over a circumferential surface of the brush core,
- wherein a group of further bristle clusters is attached in each case to the brush core between two bristle clusters having the first length, and
- wherein the bristle clusters and the further bristle clusters are arranged on the brush core in at least one plane, the at least one plane being parallel to a surface to be cleaned.

2. The side brush of claim 1, wherein the further bristle clusters of the plurality of further bristle clusters are of the same length.

3. The side brush of claim 1, wherein, in each group of further bristle clusters, the length of one of the further bristle clusters is longer or shorter in relation to the length of a closest of the further bristle clusters.

4. The side brush of claim 1, wherein, in each group of further bristle clusters, the length of the further bristle clusters increases and decreases in an alternating manner in relation to a closest of the further bristle clusters.

5. The side brush of claim 1, wherein the bristle clusters and the further bristle clusters are each fastened to the brush core in an orientation that is tangential to the circumferential surface of the brush core.

6. The side brush of claim 5, wherein the bristle clusters and the further bristle clusters are fastened to the brush core in such an orientation that the tips of all the bristle clusters and of all the further bristle clusters are positioned in a common plane.

7. The side brush of claim 1, wherein the at least one plane comprises at least two parallel planes on the brush core, and wherein at least some of the plurality of bristle clusters and/or at least some of the plurality of further bristle clusters are arranged in each plane of the at least two parallel planes.

8. A robotic vacuum cleaner comprising at least one side brush according to claim 1.

9. A side brush for a robotic vacuum cleaner, the side brush comprising:
- a brush core;
- a plurality of bristle clusters having a first length; and
- a plurality of further bristle clusters having a shorter length than the first length,
- wherein the plurality of bristle clusters and the plurality of further bristle clusters are regularly distributed over a circumferential surface of the brush core, and
- wherein the bristle clusters and the further bristle clusters are each fastened to the brush core in an orientation that is tangential to the circumferential surface of the brush core.

10. The side brush of claim 9, wherein the bristle clusters and the further bristle clusters are fastened to the brush core in such an orientation that the tips of all the bristle clusters and of all the further bristle clusters are positioned in a common plane.

11. A robotic vacuum cleaner comprising at least one side brush, the at least one side brush comprising:
- a brush core;
- a plurality of bristle clusters having a first length; and
- a plurality of further bristle clusters having a shorter length than the first length, wherein the plurality of bristle clusters and the plurality of further bristle clusters are regularly distributed over a circumferential surface of the brush core.

* * * * *